United States Patent [19]

Rasmussen et al.

[11] Patent Number: 4,875,339

[45] Date of Patent: Oct. 24, 1989

[54] COMBUSTION CHAMBER LINER INSERT

[75] Inventors: Neil S. Rasmussen, Loveland; Li-Chieh Szema, West Chester, both of Ohio; Nesim Abuaf, Schenectady, N.Y.

[73] Assignee: General Electric Company, Schenectady, N.Y.

[21] Appl. No.: 126,041

[22] Filed: Nov. 27, 1987

[51] Int. Cl.[4] ..... F23R 3/04

[52] U.S. Cl. ..... 60/757; 60/759; 60/760

[58] Field of Search ..... 60/752, 755, 756, 757, 60/758, 759, 760; 431/350, 351, 352

[56] References Cited

U.S. PATENT DOCUMENTS

| | | | |
|---|---|---|---|
| 2,510,645 | 6/1950 | McMahan | 60/759 |
| 3,899,882 | 8/1975 | Parker | 60/759 |
| 4,622,821 | 11/1986 | Madden | 60/757 |
| 4,653,279 | 3/1987 | Reynolds | 60/755 |
| 4,700,544 | 10/1987 | Fucci | 60/759 |

FOREIGN PATENT DOCUMENTS

| | | | |
|---|---|---|---|
| 1289128 | 9/1972 | United Kingdom | 60/755 |

*Primary Examiner*—Louis J. Casaregola
*Assistant Examiner*—Timothy S. Thorpe
*Attorney, Agent, or Firm*—Jerome C. Squillaro

[57] ABSTRACT

An air admission insert particularly adapted for air admission holes in a combustor liner in a gas turbine combustion system comprises a pair of sleeve members, one of which is inserted in the other in axial but eccentric relationship so that the sides of the sleeves contact each other with the intervening space between the sleeves being crescent shaped. The insert is positioned concentrically in a combustor liner air admission hole. Combustion air flows through the insert and into the combustor liner and axially through the crescent space to cool the insert as well as the liner hold perimeter.

8 Claims, 2 Drawing Sheets

COMBUSTION CHAMBER LINER INSERT

FIELD OF THE INVENTION

This invention relates to a combustion chamber liner insert, and, more particularly, to a gas turbine combustion system utilizing a combustion liner having air inlet apertures therein in which liner hole inserts may be advantageously employed.

BACKGROUND OF THE INVENTION

In a gas turbine combustion system, the combustion chamber or casing contains a liner which is usually of a sheet metal construction and may be of a tubular or annular configuration with one closed and one opposite open end. Fuel is ordinarily introduced into the liner at or near the closed end while combustion air is admitted through circular rows or apertures spaced axially along the liner. These gas turbiine combustion or combustor liners usually operate at extremely high temperatures and depend to a large extent on incoming combustion air from an appropriate compressor for liner cooling purposes.

As a consequence of high temperature cyclic operation and existence of thermal gradients, severe liner cracks appear about the circumference of some of the liner combustion air holes leading to premature repair and sometimes to failures necessitating replacement of the liner.

DESCRIPTION OF THE PRIOR ART

A gas turbine combustion liner of the general kind described including means to compensate for high temperature thermal expansion is disclosed and described in U.S. Pat. No. 4,485,630—Kenworth assigned to the same assignee as the present invention. The Kenworthy patent describes the use of different construction materials, having different coefficients of expansion, in the combustion liner in order to compensate for high temperature induced stresses in the liner. A combustion liner utilizing inserts in air admission apertures therein is illustrated and described in U.S. Pat. No. 3,981,142—Irwin. In the Irwin patent, metal inserts are employed in a ceramic liner hole to insulate the perimeter of an air admission hole the perimeter of which has also been coated with an insulating material, to insulate the hole perimeter from cooling effects of the entering air.

Continued occurrences of metal combustion liner cracking indicates a further need for means to prevent or minimize metal liner cracking.

OBJECTS OF THE INVENTION

It is a principal object of this invention to minimize cracking of a metal combustion liner in a gas turbine engine.

It is a further object of this invention to extend the service life of a gas turbine combustor metal liner by minimizing thermal cracks therein.

It is another object of this invention to utilize particular film cooled inserts for metal combustion liner holes in a gas turbine combustor liner to minimize thermal cracks at the liner air admission holes.

SUMMARY OF THE INVENTION

A combustor liner air admission hole is fitted with an insert which comprises a part of short metal sleeves one of a larger and one of a smaller diameter. The smaller diameter sleeve fits within the larger diameter sleeve in a non-coaxial or offset relationship so that their side walls are in contact with each other, at which point the two side walls are joined to each other. The joined assembly of the two sleeves is inserted in coaxial close fitting relationship in a combustor liner air admission hole and fastened in place. Incoming combustion air flows axially through the smaller diameter sleeve with a film of air flowing through the intervening space between the sleeve walls. The air film is effective in reducing temperature related high stresses at the hole periphery. The aerodynamic shape of this assembly also permits an increase in air admission to the liner over the same physical opening of a plain liner hole.

This invention will be better understood when taken in connection with the following description and drawings.

BRIEF DESCRIPTION OF THE DRAWINGS

FIG. 6 is a view of the insert of FIG. 4 positioned in a combustion liner to illustrate air flow patterns there through.

Referring now to FIG. 1, there is schematically illustrated a section 10 of a reverse flow combustion system of a gas turbine engine of power plant. In section 10 there is also illustrated a small part of an axial flow air compressor 11. Surrounding the air compressor 11 in concentric relationship thereto is a circular row of individual tubular combustion chambers or casings 12 (only one shown). Chambers 12 are arranged in axial parallel relationship to each other but spaced apart in a circular row concentrically about compressor 11. Each tubular combustion chamber 12 includes a closed end 13 and an open end 14. Concentrically positioned within and in spaced relationship to each casing 12, is a tubular combustor liner 15 also having a closed end 16 and an open end 17. Liner 15 supports and contains the combustion process in a gas turbine engine. In this connection, a gas flow duct or transition piece 18 is connected to the opoen end 17 of the combustor 15to receive the hot gas productsof combustion therefrom and duct the hot gas to a circumferential row of nozzle guide vanes 19 (only one shown) which channel and direct the hot gases from a circular cross-section at liner open end 17 to an annular segment at the circular row of guide vanes 19. Guide vanes 19 direct the hot gases through the buckets or blades at the periphery of a turbine wheel (not shown) positioned concentrically next adjacent the circular row of vanes 19.

Figure 1:
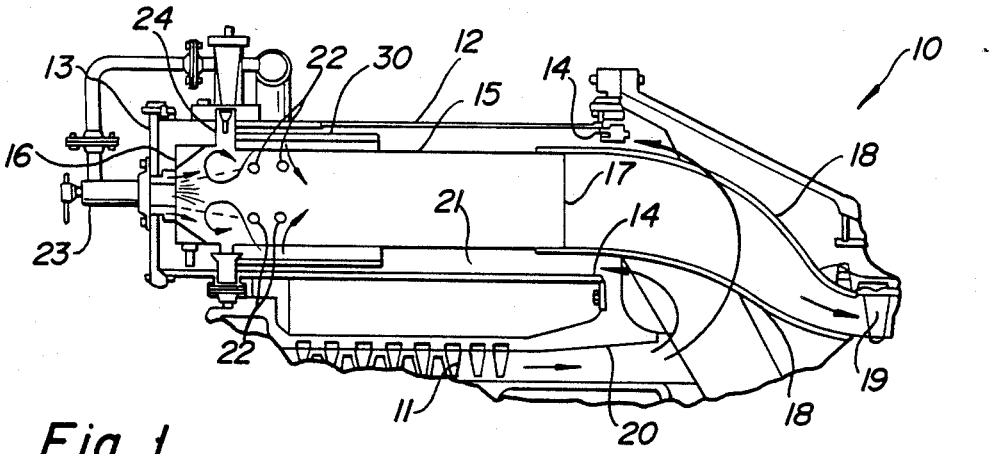
FIG. 1 is a schematic illustration of a gas turbine combustion system which may effectively utilize the insert of this invention.

As illustrated by arrows in FIG. 1, air from compressor 11 flows through a compressor casing 20 and radially about the duct members 18, as illustrated by the flow arrows, and then axially into the annular space 21 between liner 15 and combustor casing 12. Liner 15 includes a plurality of axially spaced circumferential rows of large combustion air apertures 22 commencing near closed end 16 and extending axially along liner 15, for example 3 rows of 8 apertures in each row (only 2 rows shown). A suitable liquid fuel is sprayed into liner 15 from a fuel nozzle 23 in the closed end 16 of liner 15. Fuel from nozzle 23 is mixed with combustion air from apertures 22, and ignition of the fuel air mixture takes place by means of an appropriate electrical spark ignition device 24 inserted in liner 15 adjacent closed end 16.

The combustion system as described is referred to as a reverse flow or counter current system. For example, in FIG. 1 combustion air from compressor 11, at elevated pressure, flows into annular space 21 axially in a direction towards closed end 16, and because of closed end 16, combustion air is caused to flow through apertures 22 by turning a first 90 degrees to flow through apertures 22 into liner 15 to be mixed with fuel. Ignition of the fuel-air mixture generates very hot combustion gases which flow axially towards and through open end 17 of liner 15. For this reason, the combustion air which enters liner 15 through apertures 22 is caused to turn a second 90 degrees and flow axially with the hot combustion gases out of liner 15 and into transition piece 18. This final flow direction is a reverse direction, e.g. the final direction path of combustion air is in a direction 180 degrees from the direction of the combustion air flow in annular space 21, and accordingly serves as the basis for referring to the combustion system as a reverse flow system.

Liner 15 is usually of a sheet metal construction and is exposed to extremely high combustion temperatures which may cause structural failure of liner 15. For this reason, liner 15 is further provided with a plurality of axially spaced circumferential rows of smaller cooling air apertures 25 as illustrated in FIG. 2.

Figure 2:
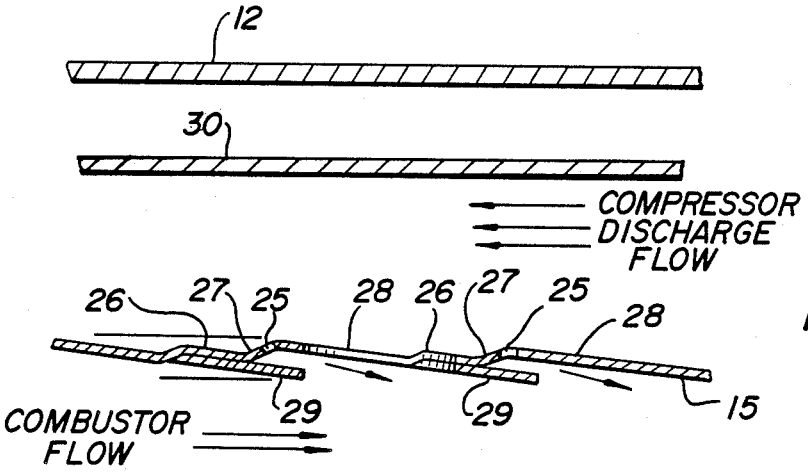
FIG. 2 is a schematic and cross-sectional illustration of a section of a combustion liner in a gas turbine combustion system.

Referring now to FIG. 2, a cross-section of a combustion chamber or casing 12 and liner 15 is schematically illustrated. Liner 15 may be generally described as having a circumferentially corrugated wall comprising an axially extended array of smaller circular offset bands 26 leading to adjacent lateral bulges or corrugations 27. Each corrugation 27 includes at the maximum diameter of each bulge thereof, an axially extending relatively flat band part 28 which tapers axially and circumferentially in a truncated cone configuration to the next adjacent smaller offset band 26 followed by a bulge 27, band 28, band 26, etc. As more clearly shown in FIG. 2, at the maximum diameter part of the bulge 27, there is provided a circular row of smaller cooling air apertures 25. Liner 15 also includes a short internal sleeve member or band 29 which fits complementarily adjacent offset 26 at the interior of liner 15. Sleeve member 29 extends axially under an adjacent bulge 27 and the cooling apertures 25 therein, and serves to channel incoming air through cooling apertures 25 as an air film along the interior wall section of liner 15 to provide, in one sense, a boundary layer of air flowing adjacent the liner wall and shielding the wall from intense combustion temperatures within liner 15. Also, a large flow sleeve 30 (FIGS. 1 and 2) may be concentrically positioned about liner 15 in the annular space 21 (FIG. 1) to serve as further air flow control means to direct air from compressor 11 more effectively to the vicinity of apertures 22 and 25. The relative location of a large aperture 22 and smaller cooling apertures 25 in a liner 15 is more clearly illustrated in FIG. 3, which is a top or outside view of the liner of FIG. 2.

Figure 3:
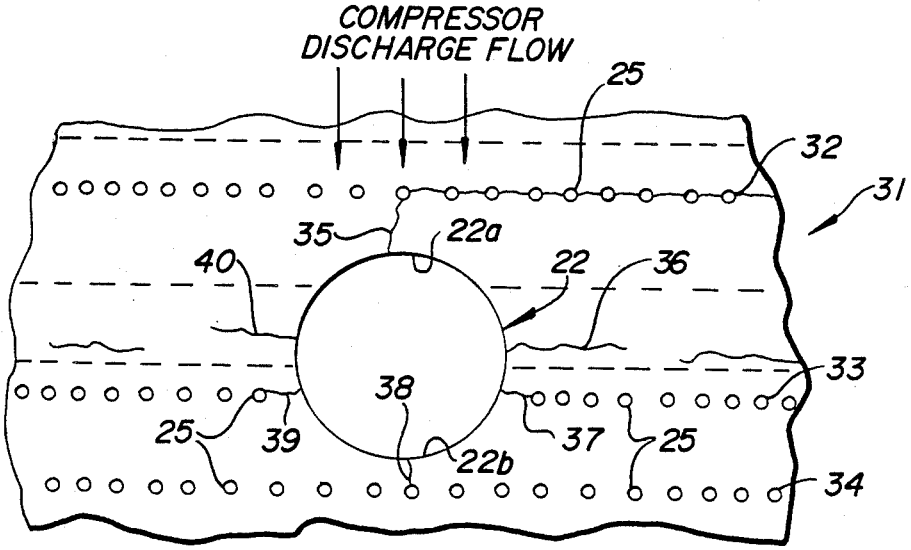
FIG. 3 is a schematic illustration of a top view of a section of a metal combustion liner, rotated at ninety degrees to FIG. 2, showing a combustion air admission aperture and associated liner cracking.

Referring now to FIG. 3, a section 31 of liner 15 includes spaced axial rows 32–34 of apertures 25 as well as one large combustion air aperture 22. Air flow from the compressor 11 (FIG. 1) passes laterally over section 31 across the plane of aperture 22 in a direction perpendicular to the horizontal rows 32, 33 and 34 of cooling air apertures 25 as illustrated by the arrow F which represents compressor air flow. An example of the noted cracking problem is illustrated by crack lines 35–40. Cracks 35–37, 38 and 39 extend radially outwardly from aperture 22 to reach an adjacent cooling aperture 25. Corresponding to the air flow as described, crack line 35 starts from the hot inside edge **22*a* aperture 22 to reach an adjacent cooling aperture 25. Corresponding to the air flow as described, crack line 35 starts from the hot inside edge 22*a* of aperture 22 while crack 38 starts from the cold outside edge 22*b* of aperture 22. Such cracking appears to be continuous and leads to structural failure of the liner. Air from the compressor 11 which passes through apertures 22 maintains the perimeter of the aperture on the outside of liner at a relatively cool temperature. However, the inner periphery of the aperture 22 inside liner 15 is exposed to high intensity combustion and operates at a very high temperature. Such a temperature differential may contribute significantly to cracking or contribute to acontinuance of existing cracking. Further the air flow from compressor 11 in turning the first 90 degrees as described, may be subject to flow separation from the inside edge of apertures 22** so that this edge in the 90 degree curve experiences a higher temperature than the outside edge a circumstance which also may have deleterious effects with respect to cracking.

The present invention provides a film cooled insert for aperture 22 to prevent or minimize the noted cracking. One preferred insert is schematically illustrated in FIG. 4.

Figure 4:
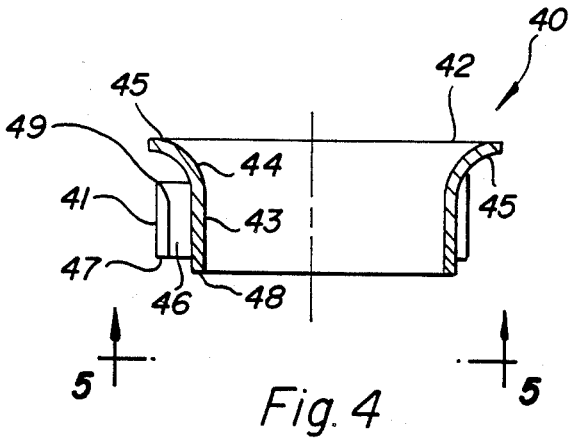
FIG. 4 is a schematic cross-sectional and side elevation illustration of one preferred insert of this invention.

FIG. 4 illustrates one preferred embodiment of a combustor liner insert 40 according to the invention. Liner insert 40 comprises an outer short cylindrical sleeve or ring 41 of about 0.36 in. height, about 1.36 I.D. and about 1.5 in O.D. Fitted within cylindrical sleeve 41 is a flared or bell mouth sleeve 42 comprising a lower cylindrical section 43 and an upper flared or bell mouth section 44 which is coterminous with section 43. The flaring of section 44 continues until the flare defines an annular lip 45 whose plane is perpendicular to the longitudinal axis of cylindrical section 43. In one practice of this invention, lip 45 was formed with 0.25 in. radius. In addition, the O.D. of cylindrical section 43 of sleeve 42 is significantly less than the I.D. of first sleeve 41 so that sleeve 42 may be axially inserted into sleeve 41 and moved into an eccentric position until the cylindrical section 43 of sleeve 42 engages the inner wall of sleeve 41 and the lower square edge 48 of sleeve 42 projects through the plane of the lower edge 47 of sleeve 41. In this position the lower square edge 47 of sleeve 41 is in staggered relationship to lower edge 48 of sleeve 42 but may be coplanar therewith. The inner and outer walls of sleeve 41 meet at a sharp edge 49 at the upper end thereof.

At the eccentric juncture of the two sleeves, an appropriate weld, braze or other suitable fastening technique joins sleeves 41 and 42 into an integral insert.

While welding or brazing of two separate cylinders is a convenient manufacturing method for the insert of the present invention, the insert 40 may be manufactured, for example, as a single piece, by means of a metal casting process. As described, the insert of this invention may be produced by various manufacturing processes utilizing a variety of component parts. Broadly described, with respect to FIG. 4, for example, these processes provide a basic insert having a first wall 43 defining a cylindrical air flow passage for a flow of air axially through the insert and a second wall 41 in cooperative relationship with, and spaced from, the first wall to define a radially crescent shaped but axially directed air flow passage in adjacent and side by side relationship to the cylindrical flow passage so that a flow of air through the crescent passage is in contact with the first wall, with the first wall 43 having a flared lip overlying but spaced from the crescent shaped passage 46.

Figure 5:
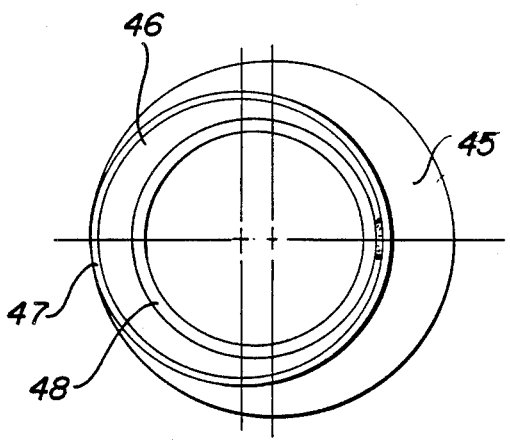
FIG. 5 is a bottom view of the insert of FIG. 4 taken along the line 5—5 thereof.

In FIG. 5, which is an axial view of FIG. 4 taken along the line 5—5 thereof, the crescent space 46 is more clearly illustrated and the center lines indicate eccentricity of sleeves 41 and 42. As shown in FIG. 4, annular lip 45 overlies sharp edge 49 but is spaced therefrom the define a peripheral or lateral opening into crescent space 46.

In one practice of this invention cylindrical section 41 had an O.D. of about 1.5 in. and the cylindrical section 43 of sleeve 42 had an O.D. of about 1.2 in. Wall thickness of both sleeves was from about 0.030 in. to about 0.040 in.

As illustrated in FIG. 4, the lower edge of sleeve 41 is a square edge 47. At the upper edge of sleeve 41 the inner surface of sleeve 41 tapers or curves outwardly to contact the outer surface with a sharp or taper edge 49. The lower edges or inner ends of both sleeves 41 and 42 may be staggered as illustrated in FIGS. 4 and 7 or coplanar.

The described intervening space 46 between the I.D. of sleeve 41 and the O.D. of sleeve 42 is utilized as an air flow channel. Insert 40 is placed in an aperture 22 of liner 15 with the widest part of the crescent space exposed directly to the air flow from compressor 11 in annular space 21. This arrangement provides the air flow pattern as illustrated in FIG. 6.

Figure 6:
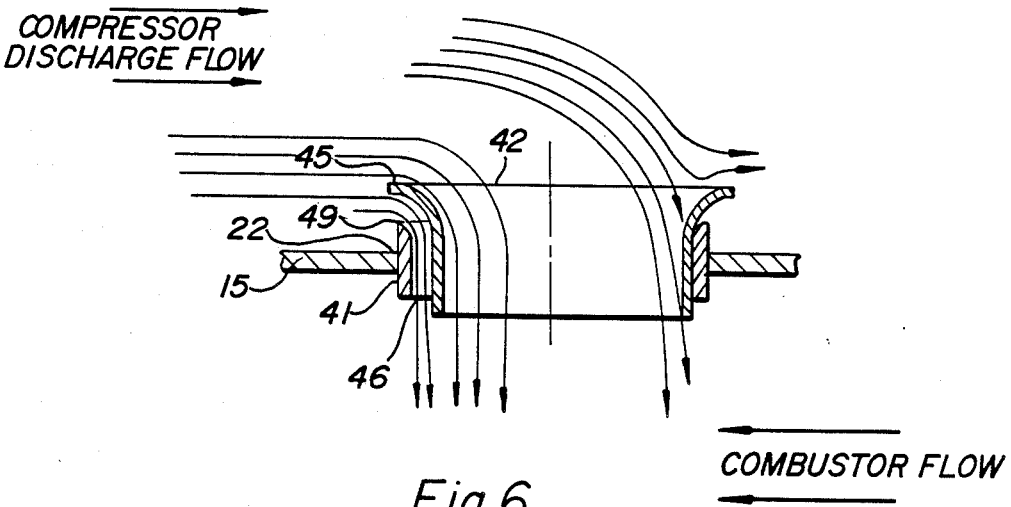

Referring now to FIG. 6, the insert 40 of this invention is illustrated in its assembled position in an aperture 22 of liner 15 with the lip 45 part of sleeve 42 projecting above the periphery of liner 15 and into annular space 21 (FIG. 1). The largest opening of the crescent shaped space 46 between sleeves 41 and 42 is positioned to be directly exposed to the air flow from the compressor 11 (FIG. 1) as noted in FIG. 6 by the appropriate labeling and associated flow arrows. As previously described with respect to FIG. 1, air flow from space 21 is caused to turn a first 90 degrees and move through apertures 22, and when the insert 40 of this invention is utilized, the described air flow turns through a first 90 degrees to move through the insert 40. The distance which square edge 48 of sleeve 42 projects through the plane of edge 47 of sleeve 41 has some effect on the depth that the air flow through the insert 40 penetrates into the combustion gas flow in liner 15. The lip part 45 of sleeve 42 in conjunction with sharp edge 49 of sleeve 41 deflects a part of the air flow through the crescent space 46 and not only maintains sleeve 41 and the adjacent periphery of sleeve 42 at a relatively cool temperature, but also maintains the periphery of aperture 22 at a cooler and constant temperature. The pre-existing temperature differential in the surrounding surface or perimeter of apertures 22 is believed to have been a contributory factor to the cracking illustrated and described with respect to FIG. 3.

Figure 7:
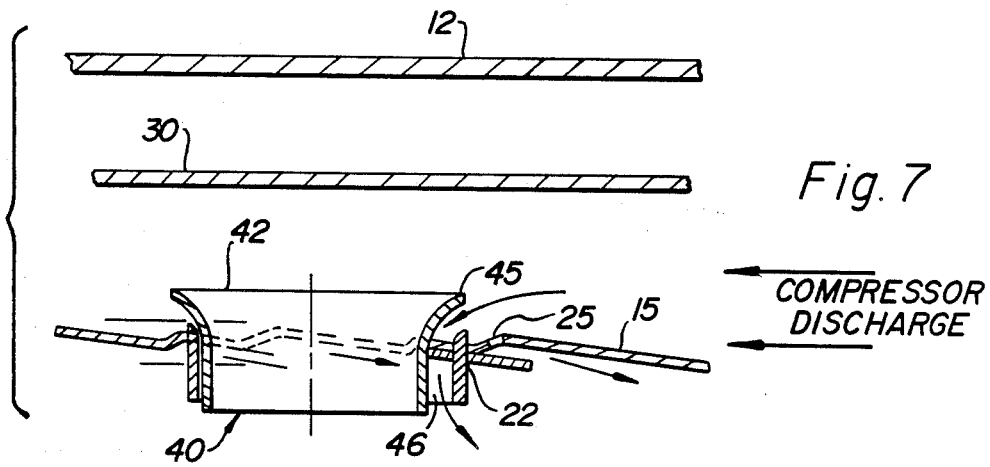
FIG. 7 is a cross-sectional illustration of the insert of this invention in an operative environment of the FIG. 2 liner and combustion system.

A cross-sectional view of an operative embodiment of this invention is illustrated in FIG. 7 in which an insert 40 (FIG. 4) of this invention is assembled in an aperture 22 in the liner of the above described FIG. 2. Flow arrows in FIG. 7 illustrate lip 45 deflecting some air flow into crescent space 46 with the main air flow passing through sleeve 42 to ameliorate the causes for cracking illustrated in FIG. 3. In the practice of this invention an insert 40 may be placed in all apertures 22 of a liner or only in those rows of apertures or certain apertures which are most prone to cracking problems. Ordinarily a plurality of inserts 40 are utilized in each liner.

In summary, the use of an insert 40 of this invention in an aperture 22 adds some uniformity to the temperature distribution about the perimeter of an aperture 22, prevents flow separation of the air flow turning from annular space 21 into and through apertures 22 and, as a consequence, tends to prevent or minimize deleterious cracking as described. In addition, insert 40 of this invention includes a very high air flow coefficient so that the prior normal or required air flow into liner 15 is not significantly altered or diminished. Air flow discharge coefficients range from about 0.6 to about 0.75 based on ordinary and usual air velocity and pressure values found in annular space 21 (FIG. 1) and within liner 15, depending on the air flow velocities and pressures outside and inside a liner adjacent an air inlet aperture. The air flow discharge coefficient C is defined as $$C_d = M_a / M_c$$

where $M_a$ is the actual air flow rate through the liner aperture and $M_c$ is the calculated theoretical flow rate.

While this invention has been illustrated and described with respect to a preferred embodiment thereof, it will be apparent to those skilled in the art that various modifications may be made to this invention without departing from the spirit and scope of this invention as set forth in the appended claims.

What is claimed is:

1. A gas turbine combustion system combustor liner comprising in combination:

(a) a tubular wall combustor liner having a closed end and an opposite open end, (b) said liner having axially spaced circumferential rows of circular apertures in the tubular wall thereof, (c) and a film cooled insert in some of said circular apertures in said liner, said insert comprising (i) a first short cylindrical sleeve member having an O.D. appropriate for insertion in said circular apertures in said liner, (ii) a second sleeve member having a cylindrical section at its inner end and a coterminous radially outwardly flared section at the other end, (iii) said second sleeve member being inserted and positioned axially in said first sleeve member in eccentric relationship thereto so that said second sleeve member comes into radial contact with said first sleeve member to define a radially crescent shaped but axially directed flow passage between said first and second sleeve members.

(iv) said radially flared section of said second sleeve member defining an annular lip surrounding said sleeve member with the plane of said lip perpendicular to the longitudinal axis of said second sleeve, (v) said cylindrical section of said second sleeve member having an O.D. less than the I.D. of said first cylindrical sleeve member, and (vi) joining means joining said sleeves to each other at their eccentric contact juncture.

2. The invention as recited in claim 1 wherein said insert is inserted in said liner so that the said first cylindrical section is concentrically positioned in said liner aperture and joined to the perimeter of said aperture so that the said annular lip of said second sleeve projects above the periphery of said liner.

3. The invention as recited in claim 1 wherein sid first cylindrical section is positioned in said liner aperture to project into said liner.

4. The invention as recited in claim 1 wherein said first cylindrical sleeve member wall has a substantially square edge at one end and a sharp edge at the other end, and wherein said annular lip overlies said sharp edge in spaced relation thereto to define a peripheral opening into said crescent shaped axial flow passage.

5. The invention as recited in claim 1 wherein the inner end of said second cylindrical sleeve member projects through the plane of the inner end of said first sleeve member.

6. The invention as recited in claim 1 wherein said insert is positioned in said liner so that said peripheral opening into said crescent passage is onthe side of said insert directly exposed to the direction of air flow in said passage between said liner and said casing.

7. The invention as recited in claim 5 wherein the inner end of said sleeve member projects through the plane of the square edge end of from about 0.06 in. to about 0.12 in.

8. The invention as recited in claim 7 wherein said end of said sleeve member projects about 0.12 in. through said plane.

* * * * *